US006216346B1

(12) United States Patent
Wechsler

(10) Patent No.: US 6,216,346 B1
(45) Date of Patent: Apr. 17, 2001

(54) HAND-HELD CUTTER

(76) Inventor: Lawrence I. Wechsler, One Wooleys La., Great Neck, NY (US) 11023

( * ) Notice: Subject to any disclaimer, the term of this patent is extended or adjusted under 35 U.S.C. 154(b) by 0 days.

(21) Appl. No.: 09/307,380

(22) Filed: May 7, 1999

Related U.S. Application Data

(60) Provisional application No. 60/084,764, filed on May 8, 1998.

(51) Int. Cl.[7] ..... A24C 5/12
(52) U.S. Cl. ..... 30/113; 30/111; 30/278
(58) Field of Search ..... 30/113, 111, 109, 30/278

(56) References Cited

U.S. PATENT DOCUMENTS

| | | | | |
|---|---|---|---|---|
| 1,156,158 | * | 10/1915 | Leidel | 30/113 |
| 1,199,784 | * | 10/1916 | Hall | 30/113 |
| 1,269,593 | * | 6/1918 | Fuller | 30/113 |
| 1,294,479 | * | 2/1919 | Kollmar | 30/113 |

FOREIGN PATENT DOCUMENTS

| | | | | |
|---|---|---|---|---|
| 232455 | * | 4/1925 | (GB) | 30/113 |

* cited by examiner

*Primary Examiner*—Hwei-Siu Payer

(57) ABSTRACT

A hand-held cutter includes two support members in overlying mounted engagement and slidable with respect to one another along a common axis. A blade member, configured to include a convexly arcuate blade edge, is sandwiched between the two support members, and eccentrically supported at opposed peripheral locations thereon adjacent the blade edge. One of the support members includes a receiving hole of suitable diameter to permit passage of a head of a cigar, or other material or article to be cut or trimmed, at least partially therethrough. The support members are slidably movable from a primed position in which the cutting edge of the mounted blade is free of the receiving hole, to another position, following passage of the blade, edge-first, across the receiving hole. Rotational motion is imparted to the arcuately shaped blade edge in response to sliding of the support members relative one another.

5 Claims, 3 Drawing Sheets

FIG. 4
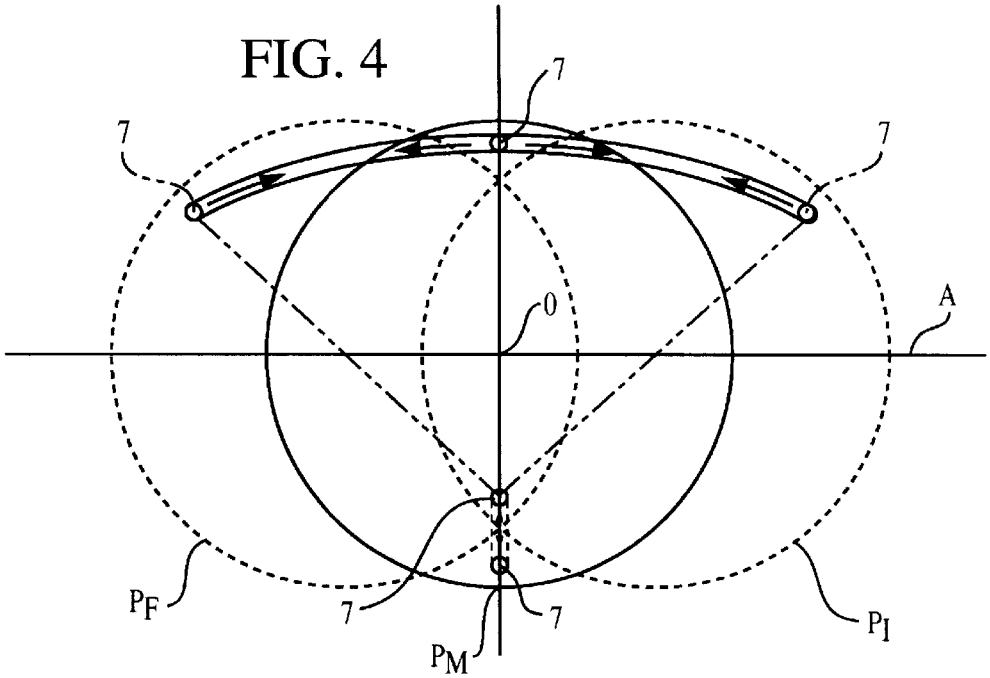
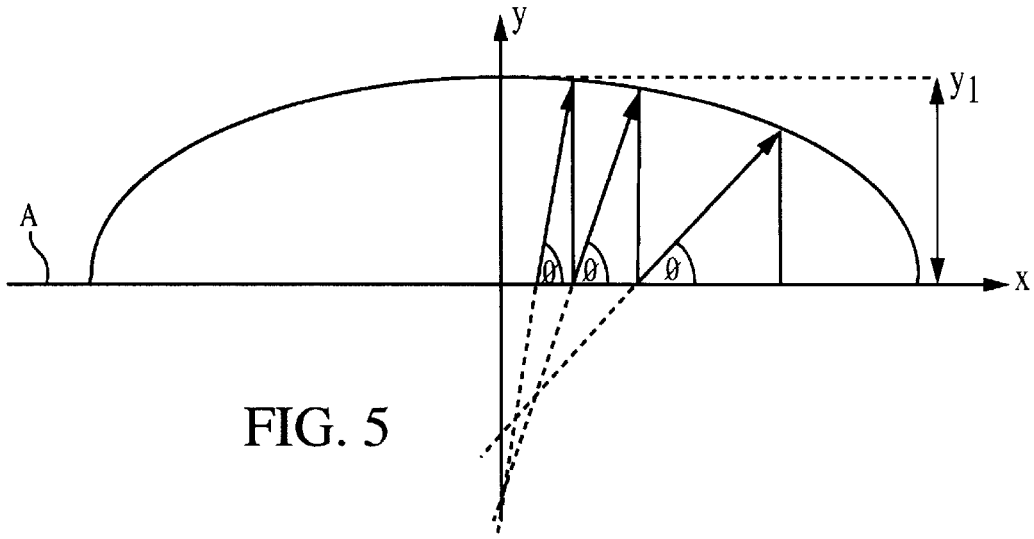
FIG. 5

HAND-HELD CUTTER

CROSS REFERENCE TO RELATED APPLICATIONS

This application claims the benefit of U.S. Provisional Application No. 60/084,764 filed May 8, 1998 entitled HAND-HELD CUTTER.

BACKGROUND OF THE INVENTION

The present invention relates to a device for cutting various elongate materials, and more particularly a cutter, suited for example to embodiment as a hand-held and operated device for preparing the head of a cigar for smoking, or alternatively for facilitated cutting of rope, tape or other binding material to a desired length.

Cigar cutters and punches are well known in the art, and a variety of versions are widely used by cigar smokers to trim the head of a cigar, particularly those that are hand-rolled, prior to lighting. Cigar cutters are distinguished from cigar punches in that the latter devices operate to puncture or remove a demarcated punched section from the head end of a cigar, whereas cigar cutters utilize a blade-cutting action directed crosswise the length of a cigar.

Cigar cutters include, for example, the once prevalent "V" cutter, in which the head of the cigar is generally seated in a receiving chamber having an appropriately configured aperture across which a wedge-like, V-shaped blade slidably traverses, to cut out a correspondingly shaped wedge cross-wise from the head of the cigar.

An alternate arrangement includes two blade members presenting concave arcuate blade edges, the blade members being mounted for overlying slidable movement with respect to one another, with the respective blade edges positioned in opposition to one another. A cigar end is placed between the opposed blade edges, and cut by urging together of the blade members which slidably overly each other.

Another type of currently popular cutter consists of a simple guillotine arrangement in which a flat blade member is mounted to a body for slidable movement with respect thereto. A blade edge, generally oriented on a bias with resect to a direction of blade travel, traverses an aperture formed in the cutter body within which the head of the cigar is receivable.

In each of the aforementioned cutters, the cutting mechanism involves a simple chopping motion, the blade edge remaining stationary with resect to a blade advancement axis. Because chopping is a mechanically inefficient blade operation, application of significant pressure is often required to effect cutting, particularly when used to prepare larger ring gauge or tightly rolled cigars. Also, once the cutting edges of the blade or blades have been significantly dulled over time, the cigar may be damaged as a result of a cut, resulting in a frayed wrapper or more significant damage to the head.

Therefore, a cutter in which a blade is drawn laterally across the object to be cut while transverse pressure is applied by a user, for example in which a novel blade transport mechanism imparts simultaneous rotation to the blade to effect a more effective slicing type operation for cutting of various materials cleanly and easily, would be highly desirable. Moreover, a cutter directed to pre-smoke cigar preparation which would allow the cutting of the head of a cigar before lighting in a manner requiring reduced user effort and less incidence of damage to the cigar, thereby maintaining structural integrity of the prepared cigar after cutting, would be highly advantageous.

OBJECTS AND SUMMARY OF THE INVENTION

Accordingly, it is an object of the invention to provide a cutter useful for cutting various articles and materials which overcomes the drawbacks of the prior art.

It is a further object of the invention to provide a cutter suitable to embodiment as a hand-held and operated cutter which requires less effort on the part of the user, even when cutting resistant materials.

It is yet another object of the invention to provide a cutter which, when embodied as a hand-held and operated cutter directed to pre-smoke preparation of a cigar end, permits simple and reliable transverse cutting of the head of the cigar, and which operates on a slicing mechanism aimed at protecting the cigar from mechanically induced damage.

It is a still further object of the invention to provide a cigar cutter in a form which is conveniently carried, economical, and versatily functional.

Briefly stated, there is provided a hand-held cutter comprising two support members, which are, for convenience, of relatively flattened configuration, and which are in overlying mounted engagement and slidable with respect to one another along a common axis. A blade member, configured to include a convexly arcuate blade edge, is sandwiched between the two support members, and eccentrically supported at opposed peripheral locations thereon adjacent the blade edge. One of the support members includes a receiving hole of suitable diameter to permit passage of a head of a cigar, or other material or article to be cut or trimmed, at least partially therethrough. The support members are slidably movable from a primed position in which the cutting edge of the mounted blade is free of the receiving hole, to another position, following passage of the blade, edge-first, across the receiving hole. Means responsive to sliding of the support members relative one another for imparting rotation to the arcuately shaped blade edge are provided, whereby as the support members are urged from the open blade primed position to an operation-completed position in which the blade edge has at least partially completed lateral movement relative the support members and has sufficiently traversed the cigar-receiving opening to effect cutting of the inserted article, the blade member cuts same by virtue of simultaneous rotational (slicing) and well as relative lateral chopping movement (compressive) across the cigar-receiving opening.

According to a feature of the invention, means for eccentric support of the blade member are provided, conveniently in the form of a pair of pins protruding from each of both sides of the cutting blade. The two support members each includes a guide of arcuate shape and a straight guide, both conveniently in the form of channels (or grooves) adapted to receive the pins captively therein for movement along controlled paths configured such that relative slidable movement imparted to the support members along a common axis thereof moves the blade codirectionally with the axis while imparting rotation thereto.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4 is a sequential diagrammatic representation of the path of travel of the blade of the device of FIGS. 2, 3*a* and 3*b*; and FIG. 5 is graphical representation of the curve described by an eccentric mounting point of a blade travelling along a straight axis of movement.

DETAILED DESCRIPTION OF THE PREFERRED EMBODIMENT

Figure 1:
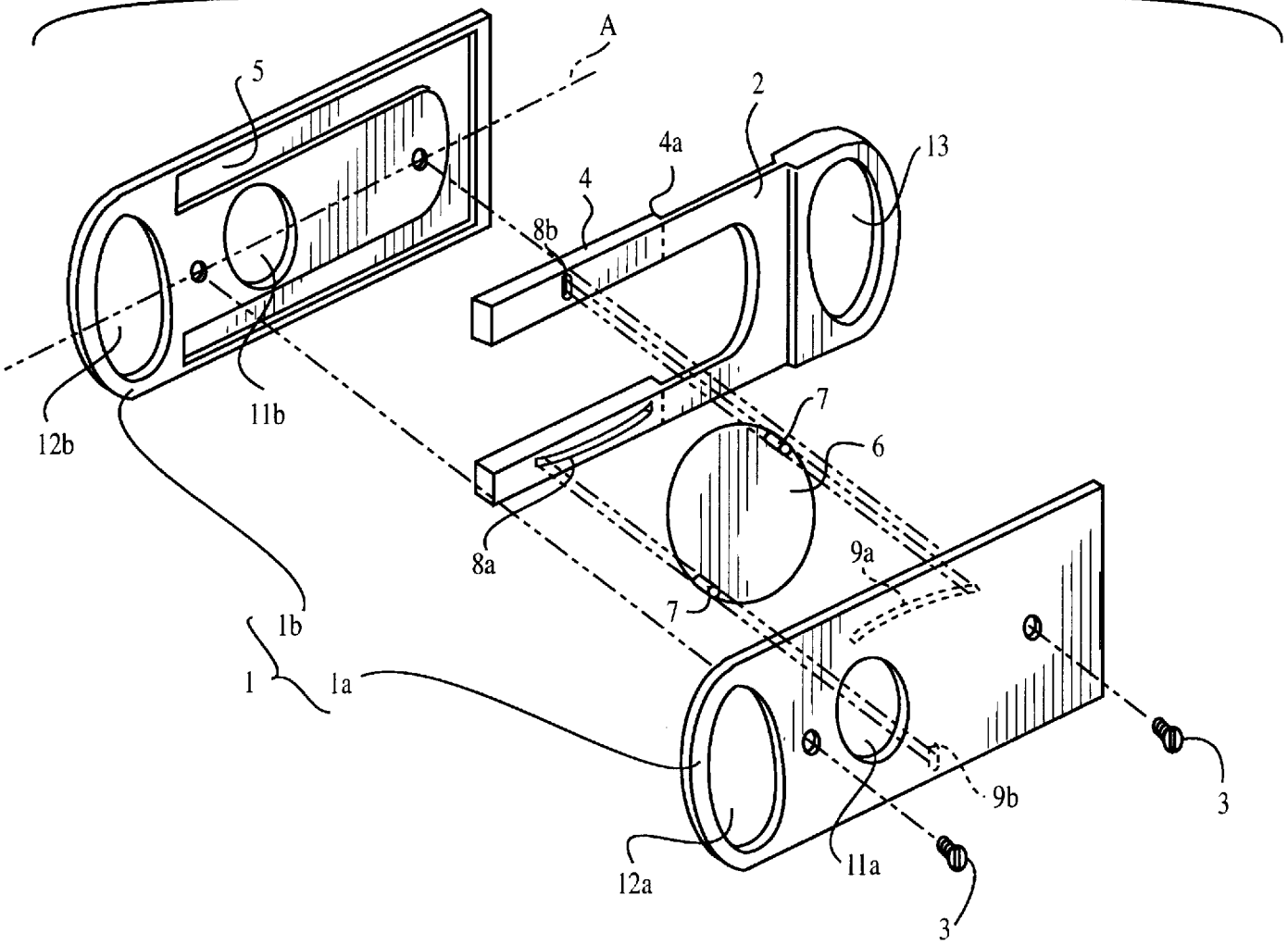
FIG. 1 is an exploded view of a cutter in accordance with an embodiment of the invention directed to a hand-held and operated cigar cutter.

Turning now to the figures, and in particular FIG. 1, an embodiment of the present invention directed to use as a hand-held and operated cigar cutter is depicted, generally designated 10. Cigar cutter 10 includes two support members 1 and 2 which are mounted in overlying engagement with one other in a manner permitting slidable movement along a common longitudinal axis A. Mounting methods currently employed for conventional cigar cutters may be readily adapted to the presently described invention, or novel approaches may be adopted. In the depicted example, support member 1 includes an operational support half 1*a* and a cover support half 1*b*, slidable mounting being advantageously achieved by captive reception of support member 2 therebetween. Support halves 1*a* and 1*b* are fastened together, conveniently by means of screws 3, positioned as not to impede slidable operation of cutter 10. Means are provided for maintaining captive retention of support member 2 between halves 1*a* and 1*b* of support member 1, conveniently in the form of an engagement portion 4 having a thicker profile than an adjacent portion of support member 2 such that a shoulder 4*a* is thereby defined at a boundary therebetween. A channel 5 is formed in cover support member 1*b* in which engagement portion 4 is received and captively held when support halves 1*a* and 1*b* are fastened together.

Figure 2:
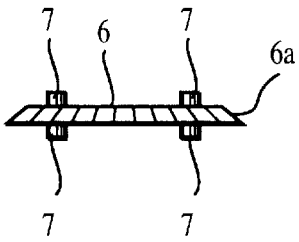
FIG. 2 is side view of the circular blade of the embodiment of FIG. 1.

A blade member 6, shown in detail in FIG. 2, is conveniently of circular shape, and includes a beveled blade edge 6*a*. As shown in FIG. 1, blade member 6 is supported in a fixed rotational plane, in juxtaposed position between operational support halve 1*a* and support member 2. Means for eccentrically mounting blade member 6 to support members 1 and 2 are provided for permitting restricted rotation about a rotational axis slidably movable along common axis A. In the depicted example, such mounting means include a pair of pins 7 extending from each side of blade member 6, which are respectively received for slidable movement, on one side of blade member 6 within an arcuate channel 8*a* and a pin reciprocation channel 8*b*formed in a facing surface of support member 2, and on the other side of blade member 6 within an arcuate channel 9*a* and a pin reciprocation channel 9*b* formed in a facing surface of operational support half 1*a*.

Operational support half 1*a* includes an article reception hole 11*a*, a center of which is advantageously positioned along axis A. Cover support half 1*b* also includes a corresponding article reception hole 11*b*, positioned to align with article reception hole 11*a* when support halves 1*a* and 1*b* are fastened together, to collectively define an article reception hole 11. In analogous fashion, support halves 1*a* and 1*b* (collectively designated support member 1) include finger reception holes 12*a* and 12*b*, respectively. Support member 2 includes a corresponding finger reception hole 13 of configuration approximating mutually aligned reception holes 12*a* and 12*b* (collectively defining a reception hole 12). Finger holes 12 and 13, although not integral to the invention nor required for operation, permit convenient one-handed means for slidably moving support members 1 and 2 with respect to one another.

Figure 3A:
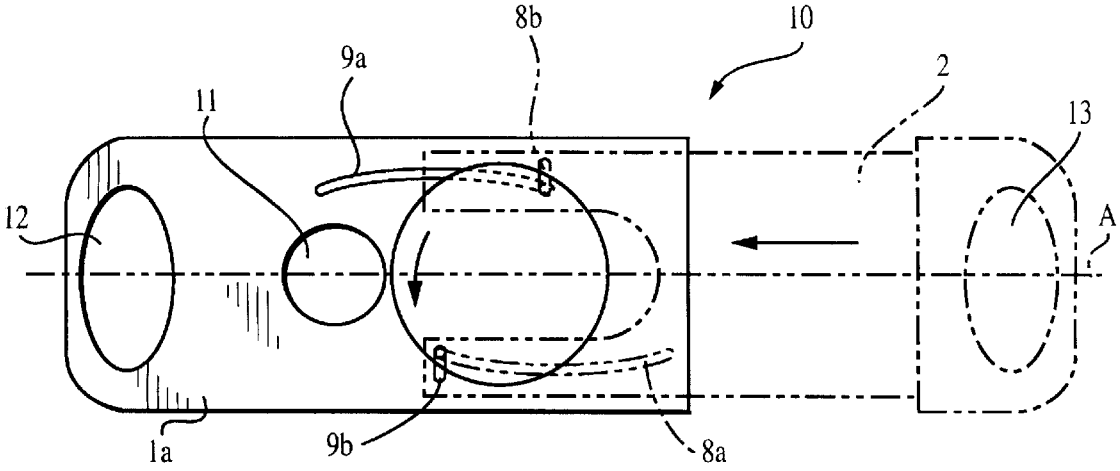
FIG. 3*a* is a plan view of a cutter in accordance with an embodiment of the invention shown in a primed position prior to performing a cutting operation.
Figure 3B:
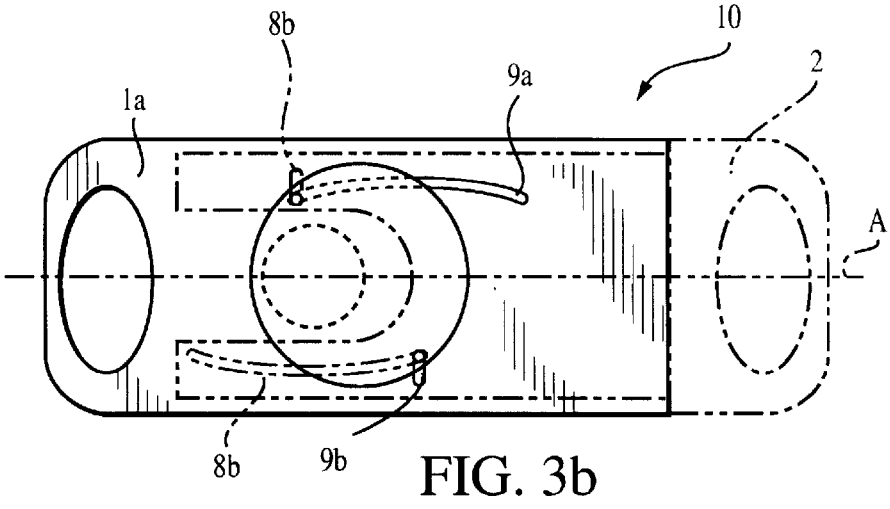
FIG. 3*b* is a plan view of the cutter of FIG. 1*a* shown in a closed position after performing a cutting operation and before being re-primed for a subsequent operation.

Operation of the cigar cutter embodiment of FIG. 1 will now be described with reference to FIGS. 3*a* and 3*b*. Cigar cutter 10 is conveniently hand-operated by insertion of a thumb and opposed finger of the same hand through finger reception hole 12 and finger reception hole 13, respectively. FIG. 3*a* depicts cigar cutter 10 in a primed position in which the cutting edge of mounted blade 6 is free of article reception hole 11 into which the cigar head is inserted prior to cutting thereof. Conveniently, opposed fingers of a user's hand are inserted into finger holes 12 and 13 and, when urged together, impart slidable movement to support members 1 and 2 with respect to one another. As support member 2 is urged to the left relative to support member 1, as shown by the arrow in FIG. 3*a*, pin 7 of blade 6 received in pin reciprocation channel 8*b* of support member 2 is forced along therewith, while pin 7 on the converse side of blade 6 is guided along in arcuate channel 9*a* formed in operational support half 1*a*. At the same time, and in analogous fashion, pin 7 in pin reciprocation channel 9*b* of operational support half 1*a* is moved to the right, while pin 7 on the converse side of blade 6 is guided in arcuate channel 8*a* formed in support member 2. As both pins are each guided in an arcuate path, pins 7 engaged in each of pin reciprocation channels 8*b* and 9*b* reciprocate up and down therewithin, while advantageously being laterally confined by the configuration of channels 8*b* and 9*b*, to prevent blade play. Continued urging results in movement of blade 6, edge first, across article reception hole 11, to a final position as shown in FIG. 3*b* with blade 6 eclipsing article reception hole 11.

Arcuate channels 8*a* and 9*a* are advantageously configured to control movement of blade member 6 such that it travels along a straight line axis of movement A as shown in FIGS. 4 and 5. As shown in FIG. 4, the circular blade member (depicted in various positions by dotted circles and a solid circle) moves between an initial primed position $P_1$ with pin 7 at the extreme right boundary of the arcuate guide channel and pin 7 at the uppermost position in reciprocating channel, a middle position $P_M$ with pin 7 at the apex of the arcuate guide channel and pin 7 at the lowermost position in the reciprocating channel, with a center of the blade member 6 corresponding in position to an origin O of the depicted coordinates and a final position $P_F$ with pin 7 at the extreme left boundary of the arcuate guide channel and pin 7 returning to the uppermost position in the reciprocating channel. The pin 7 follows an arcuate path defined by the graph shown in FIG. 5 relative x and y axes in which the blade travels in the x direction with the center of the blade traveling along axis A, and in which the blade is mounted, for example by a pin located a distance $y_1$ away from the blade center. As the blade member 6 moves in the x direction, an angle $\phi$ is formed between the axis A and a straight line connecting opposed pins 7. The angle $\phi$ changes as the blade moves with its center along axis A (three arbitrary blade positions and corresponding angles $\phi$ being shown in FIG. 5 for purposes of illustration). Since the arrow segments comprising the triangles, and which represent the distance between the blade center and each of the pins, remain constant independent of axial position of the blade, as shown, an equation defining the arcuate path as a function of blade travel distance can be mathematically derived in a simple manner applying well-known trigonometric principles.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cutting device, comprising:

a first support member and a second support member mutually mounted for slidable movement relative one another along a common axis;

a blade member presenting a curved blade edge, said blade member being received between confronting surfaces of said first and second support members;

engagement structure for movably coupling said blade member with each of said first and second support members, said engagement structure including first and second engagement parts engaged with said blade member at first and second eccentric positions of said blade member, respectively, said first and second eccentric positions being located radially across from one another on said blade member, a one of said first and second engagement parts being engaged with said first support member in a manner restricting movement of said one of said first and second engagement parts codirectionally with said axis relative said first support member and being engaged with said second support member in a manner permitting travel of said one of said engagement parts relative thereto along an arcuate path, and another of said engagement parts in said second eccentric position being engaged with said second support member in a manner restricting movement of said another of said first and second engagement parts codirectionally with said axis relative said second support member and being engaged with said first support member in a manner permitting travel of said another of said first and second engagement parts relative thereto along another arcuate path; and structure of at least one of said first and second support members defining an article reception opening through which an article to be cut is at least partially receivable, said article reception opening being disposed in a position along said axis which is at least partially traversed by said curved blade edge when said first and second support members are slidably moved relative one another.

2. A device according to claim 1, wherein said blade member is of generally circular shape.

3. A device according to claim 1, wherein:

said first support member is comprised of an operational support half and a cover support half;

a portion of said second support member is captively received between said operational support half and said cover support half; and said blade member is received between said operational support half and said second support member.

4. A device according to claim 3, wherein:

said article reception opening is defined by aligned holes in said operational support half and said cover support half; and said portion of said second support member includes bifurcated support structure arranged parallel with said axis, said bifurcated support structure being disposed radially outward of opposed sides of said article reception opening.

5. A cutting device, comprising:

a first body portion and a second body portion mounted together for slidable motion relative one another along a common axis;

a blade member presenting an arcuate blade edge, said blade member being disposed in juxtaposed position between said first and second body portions; and engagement members for movably coupling said blade member with each of said first and second body portions, said engagement members being disposed at first and second eccentric positions of said blade member located radially across from one another on said blade member, a one of said engagement members in said first eccentric position being engaged with said first body portion in a manner restricting movement of said one of said engagement members codirectionally with said axis relative said first body portion and being engaged with said second body portion in a manner permitting travel of said one of said engagement members relative thereto along an arcuate path, and another of said engagement members in said second eccentric position being engaged with said second body portion in a manner restricting movement of said another of said engagement members codirectionally with said axis relative said second body portion and being engaged with said first body portion in a manner permitting travel of said another of said engagement members relative thereto along another arcuate path.

* * * * *